US010513134B1

(12) United States Patent
Chen

(10) Patent No.: US 10,513,134 B1
(45) Date of Patent: Dec. 24, 2019

(54) HAND STAMP WITH REMOVABLE DIE BOX

(71) Applicant: Gau Chen, Shanghai (CN)

(72) Inventor: Gau Chen, Shanghai (CN)

(73) Assignee: Shanghai Jipushen Office Articles Co., Ltd., Shanghai (CN)

( * ) Notice: Subject to any disclaimer, the term of this patent is extended or adjusted under 35 U.S.C. 154(b) by 0 days.

(21) Appl. No.: 16/008,263

(22) Filed: Jun. 14, 2018

(51) Int. Cl.
*B41K 1/36* (2006.01)
*B41K 1/56* (2006.01)
*B41K 1/38* (2006.01)

(52) U.S. Cl.
CPC . *B41K 1/38* (2013.01); *B41K 1/56* (2013.01)

(58) Field of Classification Search
CPC ... B41K 1/02; B41K 1/38; B41K 1/40; B41K 1/54; B41K 1/56; B41K 1/50
USPC ..... 101/327, 333
See application file for complete search history.

(56) References Cited

U.S. PATENT DOCUMENTS

2005/0155504 A1* 7/2005 Shih ..... B41K 1/02 101/333
2016/0067994 A1* 3/2016 Petersen ..... B41K 1/54 101/333

* cited by examiner

*Primary Examiner* — Leslie J Evanisko
(74) *Attorney, Agent, or Firm* — Knechtel, Demeur & Samlan

(57) ABSTRACT

A hand stamp that has a handle that receives a removable die box. The die box is received and held in the handle by a spring-loaded push button that has a locking mechanism that engages a locking slot in the die box. By operating the push button the locking mechanism is moved out of the locking slot to release the die box for re-inking or replacement of the porous foam material with a replacement image surface. A reversible cover engages the bottom of the handle to securely cover the die plate in a first position. When the cover is reversed, the cover acts as a protective resting place for the stamp which can be easily lifted off the cover for use by the operator.

9 Claims, 5 Drawing Sheets

HAND STAMP WITH REMOVABLE DIE BOX

BACKGROUND AND SUMMARY OF THE INVENTION

This invention relates to hand stamps and more particularly to a self-inking hand stamp that does not require an external stamp pad.

The prior art consists of many conventional stamps that require manufacturing the printing surface from rubber or other flexible material. The printing surface is securely mounted on a handle that is grasped by the user. The printing surface is placed into contact with an inkpad where ink transfers to the printing surface. The inked printing surface is then pressed against the surface onto which the stamp image is to be transferred. Repetition of the stamping process requires that the printing surface be pressed against the inkpad each time an image is to be transferred. This is a disadvantage to the user as it requires extra time for each re-inking step and slows down the stamping process if multiple stampings are to be done. It also requires the use of a separate inkpad that must be periodically re-inked.

An improved stamp was developed that uses a printing surface made from an ink permeable material that allows ink to pass from an ink storage member, through the printing surface and onto the object being marked. This eliminated the need for a separate stamp inkpad. These stamps are referred to as self-inking or pre-inked hand stamps. There is no simpler stamping device to transfer images than the pre-inked hand stamp.

An example of this stamp is illustrated in U.S. Pat. No. 5,577,444 issued to Toyama. This patent illustrates a hand stamp that has a sealed ink compartment that stores the ink. The ink can be refilled into the compartment by means of removing a threaded screw at the top of the compartment. Once the screw is removed, the ink can be injected, and the screw replaced. The stamping member has a stamping surface with stamping and non-stamping portions. The stamp pad is fixed to the stamp frame at the factory and is not designed to be field installed or removed.

There are several problems with this device. First, the porous foam or printing surface is factory sealed. If an error is made during manufacturing, the entire mount must be thrown away, thus increasing costs. Since it is factory sealed, a special machine is required to expose the porous foam to form the image on the porous foam surface.

Another type of stamp is illustrated in U.S. Pat. No. 5,942,312 issued to Venkataraman et al. This patent discloses a pre-inked thermoplastic foam which has open cells in the area that is designed to transfer ink and closed or sealed cells in the area which is designed to be impermeable to ink. The pre-inked thermoplastic foam is pre-inked before the image is formed on the thermoplastic material. Thus, if there is a problem with the image, the entire pad including the ink, is wasted. Furthermore, there may be difficulties in forming an image on a pre-inked thermoplastic foam as it may be messy or require special handling due to the ink in the pre-inked thermoplastic foam. The pre-inked thermoplastic foam is mechanically held to the stamp and assembled at the factory. The pre-inked thermoplastic foam is not designed to be installed or removed in the field.

A problem not solved by the prior art devices is providing a die box, also called a stamp frame, that holds the ink supply and printing member, in a single unit, which is easily removed from the hand stamp for re-inking or replacement.

Applicant's invention addresses and solves the problems of the prior art devices. The invention comprises a hand stamp that utilizes a porous foam layer, which is also an ink storage layer mounted in a die box within the hand stamp. The porous foam layer has the image forming stamp material on its outside surface. The image forming stamp material is a porous foam material and has an outer surface made of a porous resin layer. To form the printable image, portions of the porous resin layer are melted and solidify into impermeable areas that are ink impermeable, and other portions of the porous resin layer remain unmelted and allow ink to pass. The releasable die box is uniquely mounted in the stamp by means of releasable locking tabs. A dust cover at the bottom of the stamp snaps into place to cover the bottom of the stamp when in a stored position. The cover can be reversed to hold the stamp in an easily removed resting position when the user is in the process of stamping multiple pieces of material.

DESCRIPTION OF THE PREFERRED EMBODIMENT

Figure 1:
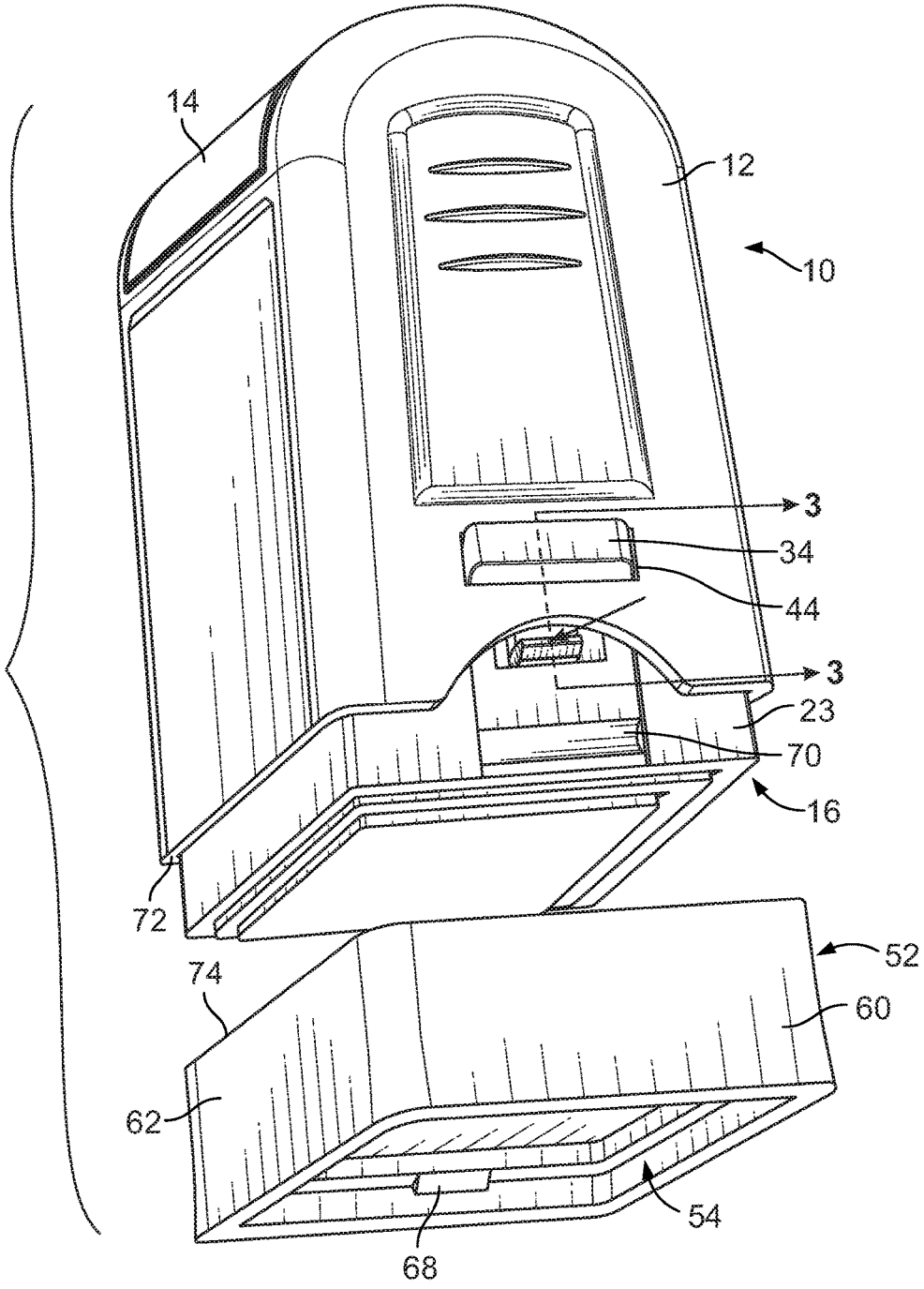
FIG. 1 is an exploded perspective view of a hand stamp illustrating the hand stamp with the dust cover separated from the hand stamp.

Turning to FIG. 1 there is illustrated a hand stamp 10, which utilizes the present invention. There is a handle 12 designed to be grasped by the user. At the top of the handle is a clear cover 14 that is designed to be removed and receive printed material such as the stamp imprint so that the user knows what the stamp imprint will be. The handle 12 is substantially hollow and receives a die box 16.

Figure 2:
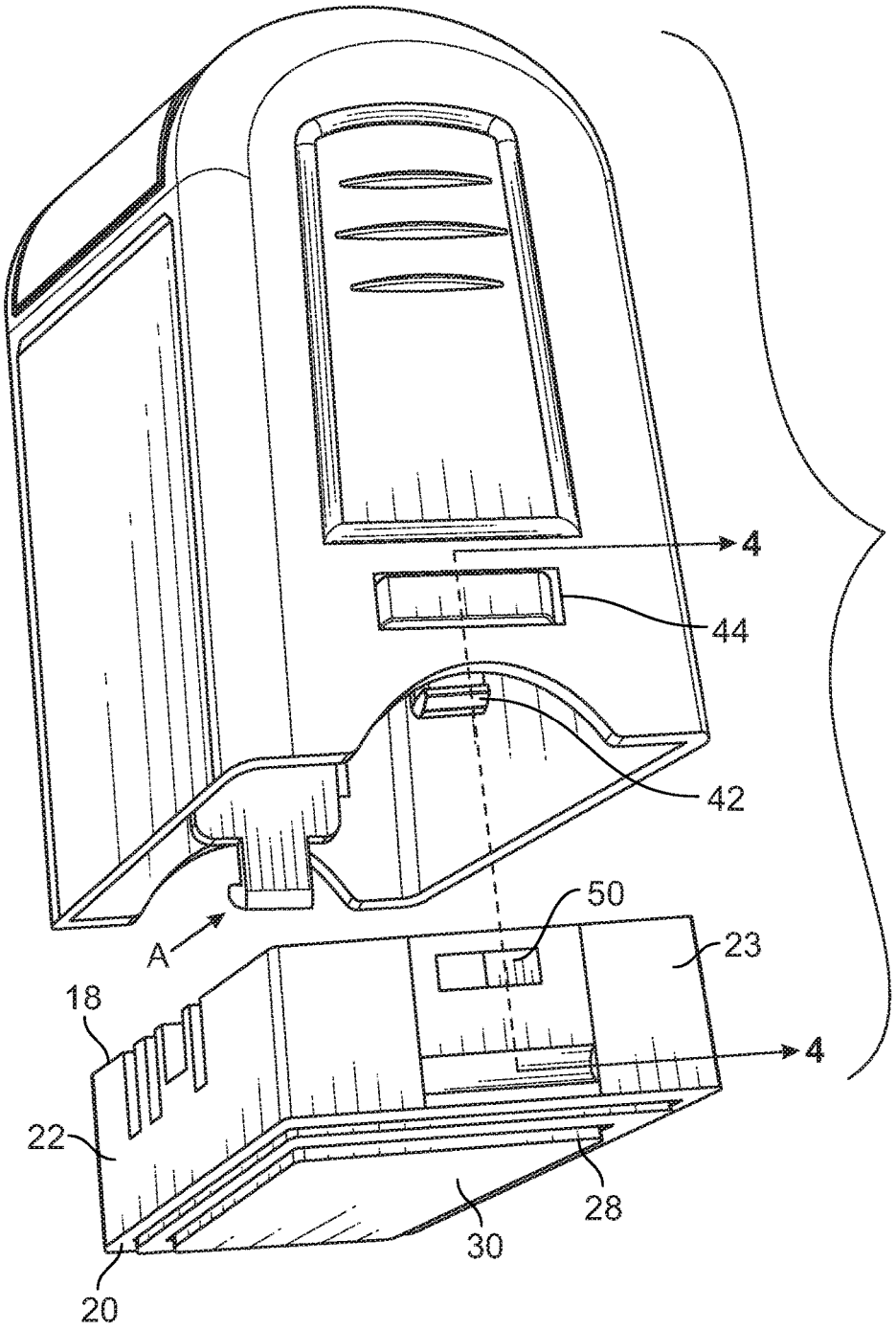
FIG. 2 is a perspective view of the hand stamp with the die box separated from the stamp handle.
Figure 3:
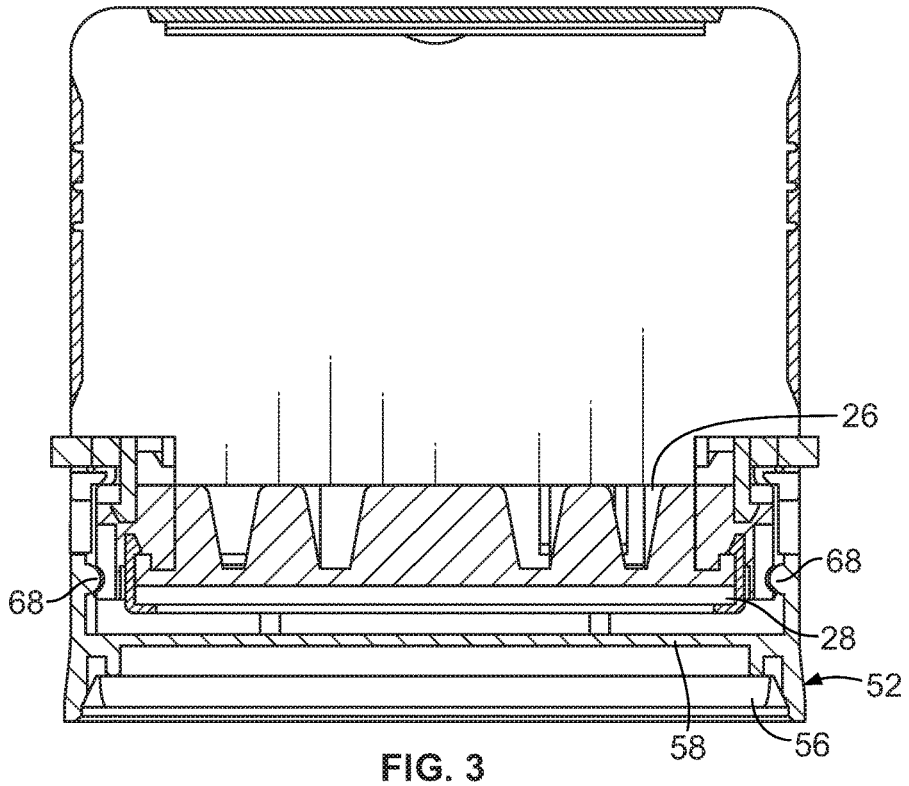
FIG. 3 is a partial cross sectional front view taken along line 3-3 of FIG. 1 illustrating the locking portions or barbs locking the die box to the handle, with the dust cover snapped to the handle and in the storage position.
Figure 4:
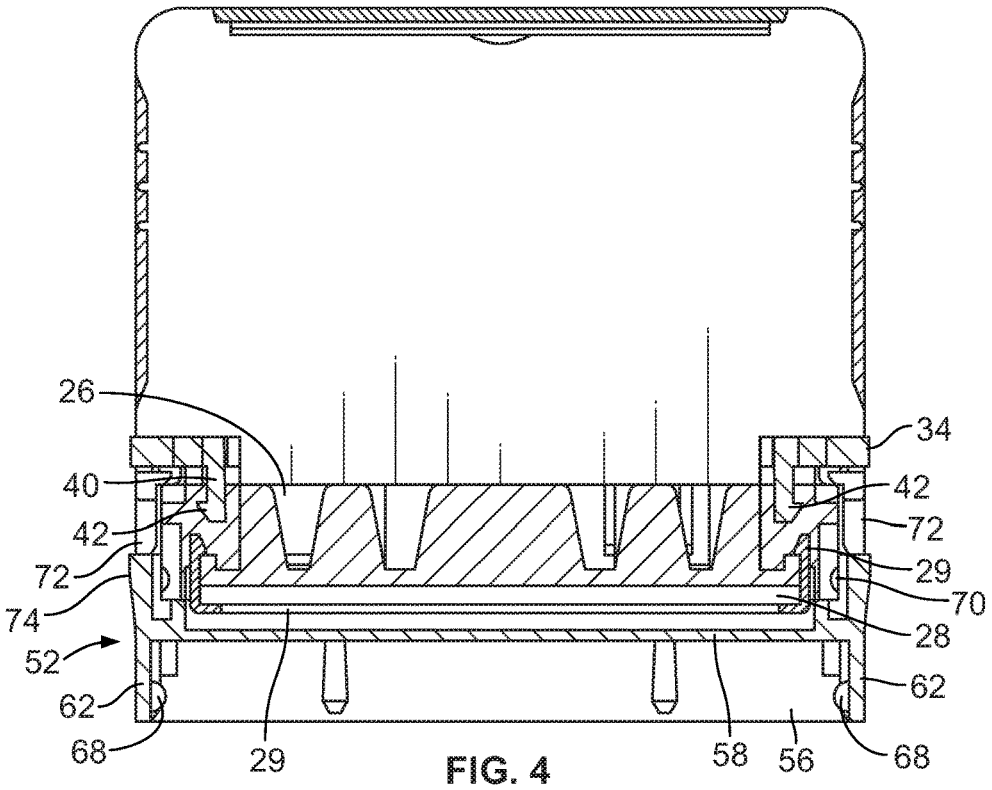
FIG. 4 is a partial cross sectional front view taken along line 4-4 of FIG. 2, except with the die box still located in the handle, illustrating the position of the locking portions or barbs in the die box release position with the stamp resting on the dust cover inverted from the position in FIG. 3 when in the unlocked and resting position.
Figure 6:
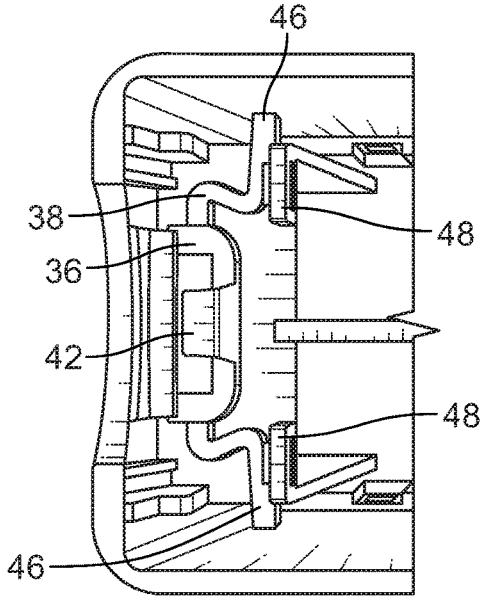
FIG. 6 is a bottom view with portions removed, of the underside of the handle illustrating the locking portion or barb depressed inwardly so that it is in the die box release position.
Figure 7:
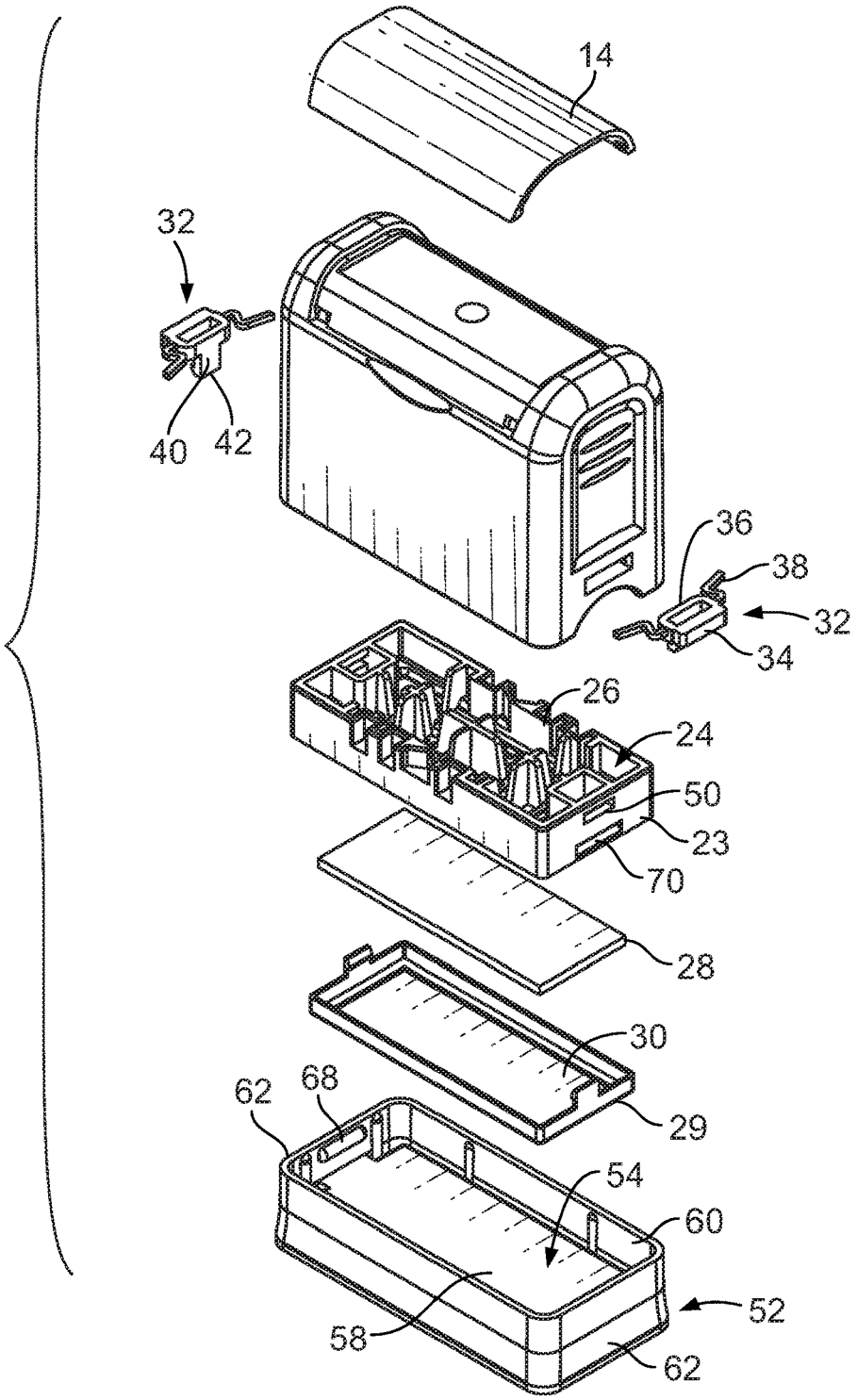
FIG. 7 is an exploded perspective view of the hand stamp, dust cover and locking tabs.

As seen in FIG. 2, the die box 16 has a top 18, a bottom 20, side walls 22 and end walls 23 that enclose a frame cavity 24 (FIG. 7). The die box 16 is illustrated as rectangular as this is the most common stamp configuration, although other geometric shapes such as square or circular can also be used. As seen in FIGS. 3, 4 and 6, the die box 16 has support ribs 26 that provide structural support by joining the bottom 20 to the side walls 22 and end walls 23. Within the die box 16 is positioned a porous foam material 28. On the outer surface of the porous foam material 28 is the printed indicia that forms the image to be transferred during the stamping operation. The porous foam material is supported by and held by a trim ring 29 surrounding the inside perimeter in the bottom of the die box 16. The method of forming the image on the foam material 28 will be described later herein. The top 18 is open so that ink can be poured onto the porous foam material 28. The support ribs 26 also assist in disbursing the ink evenly over the surface of the porous foam material 28.

The image is formed on the outer surface of the porous foam material in a generally known process. The porous foam material is made from a porous soft resin in which optical energy absorbing material is dispersed. To produce an image onto an image surface 30, a transparent film having the positive image to be created is placed against the image surface 30. The image is normally comprised of black and clear areas. With the transparent film with the image thereon against the image surface 30, the die box 16 is placed in a sealed light box with the image surface 30 pressed against a clear glass or plastic member. A xenon light is placed in the light box below the image surface 30 and energized for a predetermined time. The rays from the xenon light irradiate the image surface 30 through the transparent film wherever there were clear image areas. This causes a chemical reaction fusing the foam from the heat. This seals what were the clear areas resulting in areas that are non-permeable to the ink passing through the image surface 30. The rays do not penetrate the black image areas on the film and thus no reaction occurs on the image surface 30. These areas remain unsealed and thus ink permeable. Thus, the image is formed. Machinery for this stamp forming process is available in the industry. Other methods to form the image on the image surface 30 are available which provide ink permeable and ink impermeable areas to define the image. The porous foam material 28 can have the image formed on it before the porous foam material is inserted into the die box. In this case, once the image is formed on the porous foam material 28 using one of the available processes, the porous foam material can be inserted into the die box 16, which is them placed in the handle 12.

Figure 5:
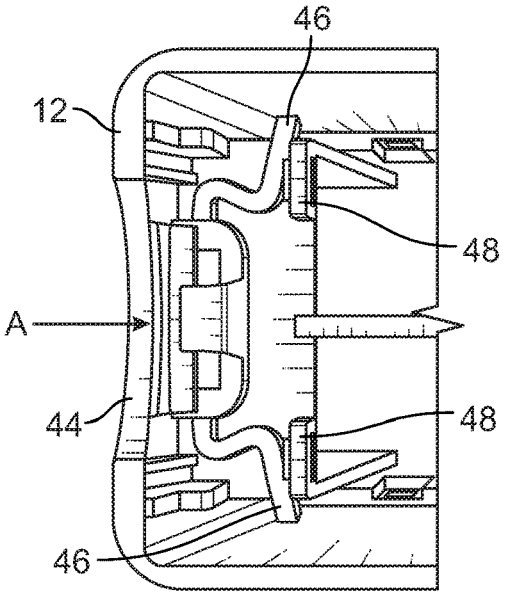
FIG. 5 is a bottom view with portions removed, of the underside of the handle illustrating the locking tab in the locked position.

A unique feature of the stamp 10 is the mechanism to hold and release the die box 16 from the handle 12. There is a pair of spring loaded locking tabs 32 with one mounted on either end of the handle 12. The spring loaded locking tabs 32 have an operator actuated push button 34, a central frame portion 36, a pair of outstanding arms 38, and a downward projecting member 40 terminating in a locking protrusion or barb 42. FIGS. 1, 5 and 6 illustrate how the spring loaded locking tabs 32 are mounted in the handle 12.

The push button 34 extends out through an opening 44 in the side of the handle 12. Opposite ends 46 of the outstanding arms 38 rest against support members 48 in the handle 12. The outstanding arms 38 are S-shaped so that they function as springs when a compressive force is applied to the arms 38 by means of the push button 34. The arms 38 are preferably made of a flexible plastic that has sufficient strength to withstand flexing yet have sufficient resilience to resume its original shape when the compressive force is removed. Any material that has these characteristics is suitable, however, plastic is preferable due to strength, weight and cost.

The die box 16 has a locking slot 50 located on either end. The locking slot 50 is in vertical alignment with the locking protrusion or barb 42 such that when the die box 16 is pushed upward from the released position illustrated in FIG. 2, the top of the die box pushes the locking protrusion or barb 42 inward so that the locking protrusion or barb 42 clears the top of the die box 16. When the locking slot 50 is in horizontal alignment with the locking protrusion or barb 42, the locking protrusion or barb 42 springs into the locking slot 50 to lock the die box 16 within the handle 12.

To release the die box 16 from the locked position in the handle 12, the user pushes inwardly on the push buttons 34 in the direction of arrow "A" in FIG. 5. The inward force pushes against the outstanding arms 38 and forces the locking protrusion or barb 42 to move inwardly to the position shown in FIGS. 4 and 6. This allows the locking protrusion or barb 42 to clear the locking slot 50 and the die box 16 is released and can be removed from the handle 12. This mechanism provides a locking means for retaining and releasing the die box from the handle.

Once the die box 16 is removed, the porous foam material can be re-inked or removed and replaced with a different porous foam material with the same or a different image on the image surface 30.

The hand stamp 10 also has a reversible dust cover 52. The dust cover has an open top 54 and an open bottom 56 separated by a central plate 58. There are side walls 60 and end walls 62. The central plate divides the dust cover into a top compartment 64 and a bottom compartment 66. There is a pair of locking bars or tabs 68 on the inside of the opposite end walls 62 of the top compartment 64. To cover the image surface 30 and prevent ink from the image surface to inadvertently be transferred to an unwanted surface, and to provide a secured protective cover over the bottom of the die box, the dust cover 52 is positioned below the bottom of the hand stamp 12 as illustrated in FIG. 1. The top compartment 64 is oriented below the die box 16. The dust cover 52 is then pushed upward or the handle 12 is pushed downward so that the dust cover is pushed onto the handle 12. The locking bars or tabs 68 snap into complementary locking bar receiving slots 70 in the end walls 23 of the die box 16. As seen in FIG. 3, this securely holds the dust cover 52 over the bottom of the handle 12. To release the dust cover 52, the user only needs to pull the dust cover 52 away from the handle 12 with sufficient force to overcome the frictional engagement of the locking bars 68 within the locking bar receiving slots 70.

As illustrated in FIG. 4, with the dust cover 62 rotated 180° so that the bottom compartment 66 is placed in an orientation with the bottom compartment 66 facing upward, the dust cover 62 now provides a resting stand for the hand stamp 12. A bottom portion 72 of the handle 12 engages a top edge 74 of the bottom compartment 66. This supports the hand stamp 12 so that the image surface 30 is raised above the central plate 58. The hand stamp 12 is in a position for the user to easily lift the hand stamp 12, perform the stamping operation, set the hand stamp back onto the dust cover 52, and undertake other procedures or prepare other materials to be stamped. There is no need to pull the dust cover apart from a locked position as there is no retaining or locking mechanism when the hand stamp 12 and dust cover 52 are in this orientation. When the stamping operation is completed, and the user wants to secure the dust cover 52 to the hand stamp 12, the dust cover 52 is rotated 180° so that the top compartment 54 is facing the die box 16 and the dust cover 52 is pushed back onto the die box until the locking bars 68 are snapped into engagement with the locking bar receiving slots 70.

Thus, there has been provided a hand stamp that has an easily removable die box and a reversible dust cover that securely attaches to the stamp handle in a first position and provides a resting stand in a second position. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A hand stamp comprising:

a handle having a top, an open bottom, front and back walls, and opposite end walls, a die box having an open top, a bottom, opposite side walls and opposite end walls defining a frame cavity, a porous foam material for receiving and storing ink and having an image surface, the porous material mounted in the die box with the image surface extending below the bottom of the die box, a locking slot in each of the die boxes opposite end walls, a push button slot in each of the handle's opposite end walls, a push button operator mounted in the push button slots with a user activated portion extending out from the handle and through the push button slot, locking means operatively connected to the push button operator for moving the locking, means into and out of engagement with the locking slots in response to movement of the push button operator, whereby the die box is secured in the handle when the locking means engage the locking slots in the die box, and the die box is released from the handle when the locking means moves out of engagement with the locking slots.

2. The hand stamp of claim 1 wherein the locking means comprises a spring member operatively connected to the push button operator, and a locking bar with an end that engages the locking slot to lock the die box to the handle.

3. The hand stamp of claim 2 wherein the end of the locking bar has a protrusion that engages the locking slot.

4. The hand stamp of claim 1 and further comprising a cover that is received at the bottom of the hand stamp, the cover having a top compartment and a bottom compartment, the two compartments separated by a central dividing plate, the upper compartment having a latching mechanism, the cover adapted for securely being mounted to the bottom of the hand stamp by means of the latching mechanism, so that an external force is required to overcome the latching mechanism to separate the cover from the hand stamp, and the bottom compartment adapted for receiving the bottom of the hand stamp in a non-retaining manner whereby the hand stamp can be removed from the cover without having to overcome any restrictive force applied by the cover to the hand stamp.

5. The hand stamp of claim 4 wherein the latching mechanism comprises a locking bar in the top compartment and a complementary locking bar receiving slot in the opposite end wall of the die box.

6. A hand stamp comprising:

a handle having a top, an open bottom, front and back walls, and opposite end walls, a die box having an open top, a bottom, opposite side walls and opposite end walls defining a frame cavity, a porous foam material for receiving and storing ink and having an image surface, the porous material mounted in the die box with the printing image surface extending below the bottom of the die box, a locking slot in each of the die boxes opposite end walls, a push button slot in each of the handle's opposite end walls, a push button operator mounted in the push button slots with a user activated portion extending out from the handle and through the push button slot, locking means operatively connected to the push button operator for moving the locking means into engagement with the push button locking slots in response to movement of the push button in a direction away from the handle for securing the die box in the handle, and for moving the locking means out of engagement with the locking slot in response to movement of the push button in, a direction into the handle for releasing the die box from the handle, a reversible cover that is received at the bottom of the hand stamp, the cover having a top compartment and a bottom compartment, the two compartments separated by a central dividing plate, the upper compartment having a latching mechanism so that an external force is required to overcome the latching mechanism to separate the cover from the hand stamp.

7. The hand stamp of claim 6 wherein the locking means comprises a spring member operatively connected to the push button operator, and a locking bar with an end that engages the locking slot to lock the die box to the handle.

8. The hand stamp of claim 7 wherein the end of the locking bar has a protrusion that engages the locking slot.

9. The hand stamp of claim 6 wherein the bottom compartment is adapted for receiving the bottom of the hand stamp in a non-retaining manner whereby the hand stamp can be removed from the cover without having to overcome any restrictive force applied by the cover to the hand stamp.

* * * * *